US010139049B2

(12) United States Patent
Lambert et al.

(10) Patent No.: US 10,139,049 B2
(45) Date of Patent: Nov. 27, 2018

(54) SUBFRAME FOR A VALVE BODY

(71) Applicant: LINDE AKTIENGESELLSCHAFT, Munich (DE)

(72) Inventors: Piers Lambert, Camberley (GB); George Gregory, Cambridge (GB); Oliver Gobold, Cambridge (GB)

(73) Assignee: LINDE AKTIENGESELLSCHAFT, Munich (DE)

( * ) Notice: Subject to any disclaimer, the term of this patent is extended or adjusted under 35 U.S.C. 154(b) by 0 days.

(21) Appl. No.: 14/432,584

(22) PCT Filed: Sep. 25, 2013

(86) PCT No.: PCT/EP2013/069954
§ 371 (c)(1),
(2) Date: Mar. 31, 2015

(87) PCT Pub. No.: WO2014/053372
PCT Pub. Date: Apr. 10, 2014

(65) Prior Publication Data

US 2015/0233529 A1 Aug. 20, 2015

(30) Foreign Application Priority Data

Oct. 1, 2012 (GB) ..... 1217552.7

(51) Int. Cl.
*F17C 13/04* (2006.01)
*F17C 13/06* (2006.01)

(52) U.S. Cl.
CPC ..... *F17C 13/04* (2013.01); *F17C 13/06* (2013.01); *F17C 2205/0323* (2013.01);
(Continued)

(58) Field of Classification Search
CPC ..... F17C 13/04; F17C 13/06; F17C 2205/03; F17C 2205/0302; F17C 2205/0305;
(Continued)

(56) References Cited

U.S. PATENT DOCUMENTS 4,521,676 A * 6/1985 Poulsen ..... F17C 13/003 220/724
5,429,152 A 7/1995 Van Straaten et al.
(Continued)

FOREIGN PATENT DOCUMENTS

CN 101068721 A 11/2007
DE 10308676 A1 9/2004
(Continued)

OTHER PUBLICATIONS

Great Britain Intellectual Property Office Search Report for Great Britain Patent Application No. GB1217552.7, dated Jan. 18, 2013.
(Continued)

*Primary Examiner* — Ian Paquette
(74) *Attorney, Agent, or Firm* — Meunier Carlin & Curfman LLC

(57) ABSTRACT

The present invention provides a sub-frame (10) for a valve body (12) having two or more location surfaces (14, 16), said sub-frame (10) comprising a first and a second portion (10*a*, 10*b*) having mutually confronting contact surfaces (18*a*, 18*b*), sides (20*a*, 20*b*) and front and back surfaces (22*a*, 22*b*) and mutually confronting engagement surfaces (24*a*, 24*b* and 26*a*, 26*b*) wherein said mutually confronting contact surfaces (18*a*, 18*b*) are shaped to engage with each other upon placement together of the two portions (10*a*, 10*b*) and said mutually confronting engagement surfaces (24*a*, 24*b* and 26*a*, 26*b*) are shaped to engage with one or other of said one or more location surfaces (14, 16) on the valve body (12).

13 Claims, 11 Drawing Sheets

(52) U.S. Cl.
CPC ... *F17C 2209/234* (2013.01); *Y10T 137/6851* (2015.04); *Y10T 137/7036* (2015.04); *Y10T 137/7043* (2015.04); *Y10T 137/7051* (2015.04); *Y10T 137/7062* (2015.04); *Y10T 137/7065* (2015.04); *Y10T 137/7833* (2015.04)

(58) Field of Classification Search
CPC ..... F17C 2205/0308; F17C 2205/0311; F17C 2205/0323; F17C 2209/234; F16K 27/00; F16K 27/003; F16K 27/12; F16L 3/00; F16L 59/161; Y10T 137/6851; Y10T 137/7036; Y10T 137/7043; Y10T 137/7051; Y10T 137/7062; Y10T 137/7065
USPC ..... 137/343, 375, 377, 379, 382, 302.5
See application file for complete search history.

(56) References Cited

U.S. PATENT DOCUMENTS

| | | | | |
|---|---|---|---|---|
| 6,311,734 | B1 * | 11/2001 | Petrovic | B05B 15/065 138/110 |
| 2002/0124887 | A1 * | 9/2002 | Anderson | E03C 1/102 137/382 |
| 2006/0065672 | A1 * | 3/2006 | Lecourt | F17C 1/04 222/3 |
| 2007/0257498 | A1 * | 11/2007 | Swain | F17C 13/002 294/27.1 |
| 2009/0038691 | A1 * | 2/2009 | Birch | F16K 1/307 137/382 |
| 2009/0050218 | A1 * | 2/2009 | Burgess | F17C 13/06 137/557 |
| 2009/0272443 | A1 * | 11/2009 | Lee | F16K 1/306 137/505.11 |
| 2015/0260343 | A1 * | 9/2015 | Baune | F17C 1/00 206/0.6 |
| 2015/0260344 | A1 * | 9/2015 | Frenal | F17C 1/00 206/0.6 |

FOREIGN PATENT DOCUMENTS

| | | | |
|---|---|---|---|
| EP | 0629812 | A1 | 12/1994 |
| EP | 2116332 | A1 | 11/2009 |
| EP | 2016329 | | 8/2011 |
| GB | 2176578 | A | 12/1986 |
| JP | 2002327899 | A | 11/2002 |
| WO | 2006060338 | A2 | 6/2006 |
| WO | 2007125240 | A2 | 11/2007 |
| WO | 2008149312 | A1 | 12/2008 |

OTHER PUBLICATIONS

International Search Report and Written Opinion, dated Jan. 20, 2014, in International Application No. PCT/EP2013/069954.
International Preliminary Report on Patentability and Annexes thereto, dated Oct. 8, 2014, in International Application No. PCT/EP2013/069954.
Office Action issued by the European Patent Office in connection with corresponding European Application No. 13766346.4, dated Apr. 18, 2016.
Examination Report No. 1, issued by the Australian Intellectual Property Office in corresponding Australian Application No. 2013326708, dated Jul. 18, 2017.
Communication pursuant to Article 94(3) EPC issued by the European Patent Office in connection with corresponding Application No. 13766346.4, dated Dec. 12, 2017 (6 pages).
Examination Report issued by the Great Britain Intellectual Property Office in connection with corresponding Application No. GB1217552.7, dated Oct. 10, 2017 (3 pages).
Examination Report under Section 18(3), issued by the Intellectual Property Office of the United Kingdom, in connection with corresponding Application No. GB1217552.7, dated May 29, 2018 (5 pages).
Examination Report No. 2, issued by the Australian Patent Office in connection with corresponding Australian Application No. 2013326708, dated Mar. 15, 2018 (3 pages).
Report of telephone consultation, issued by the European Patent Office in connection with corresponding European Application No. 13766346.4, dated Apr. 9, 2018 (3 pages).

* cited by examiner

SUBFRAME FOR A VALVE BODY

The present invention relates to a sub-frame for attachment to a body and to a body having such a sub-frame and relates particularly but not exclusively to a sub-frame for a valve body and to a valve body with such a sub-frame.

Presently, it is known that valves for gas cylinders may include a main body portion and control valves for controlling the flow of gas from the cylinder and may still further include pressure gauges/or flow meters and also possibly a handle which may form part of the valve body or may be attached thereto by some intermediate means. Whilst such arrangements can provide perfectly adequate solutions to the problem of locating suitable handles and/or gauges and meters it will be appreciated that each individual valve body must be designed to accommodate a handle and/or gauge/meter and the valve body itself may be unnecessarily complex and expensive to produce. In addition, the gauge or meter is generally quite exposed and may be liable to be damaged. Still further, standardisation of appearance is difficult as different cylinders and different gasses will require their own unique arrangements of gauges and handles.

In view of the above, there exists a requirement for an arrangement that might allow for the better mounting of ancillary components and protection thereof whilst also possibly allowing for a more uniform external appearance. The present invention also attempts to provide an arrangement which both protects the valve body whilst also providing mounting positions for gauges and meters and may also be used to provide the base for an external casing which could be of standard appearance and size regardless of valve shape or dimensions.

Accordingly, the present invention provides a sub-frame for a valve body having two or more location surfaces, said sub-frame comprising a first and a second portion having mutually confronting contact surfaces, sides and front and back surfaces and mutually confronting engagement surfaces, wherein said mutually confronting contact surfaces are shaped to engage with each other upon placement together of the two portions and said mutually confronting engagement surfaces are shaped to engage with one or other of said one or more location surfaces on the valve body.

Preferably, said mutually confronting engagement surfaces include a curved surface for engagement with correspondingly curved surfaces on one or other of said one or more location surfaces on the valve body.

Advantageously, said mutually confronting engagement surfaces comprise semi-circular recesses in the mutually confronting engagement surfaces having a radius of curvature R1, R2 and wherein said radius of curvature R1, R2 is equal to a radius R3, R4 of a corresponding location surfaces on the valve body.

Preferably, when in contact with each other, the mutually confronting contact surfaces each extend in a common plane P1.

Advantageously, said common plane P1 extends in a direction parallel to a longitudinal axis L of a valve around which said sub-frame is positioned and wherein said plane P1 is coincident with a neutral plane P2 of a valve body when positioned therearound.

Advantageously, said sub-frame further includes one or more apertures on said side surfaces for receiving one or more portions of a valve body.

Preferably, said one or more apertures include second engagement surfaces for engaging with corresponding engagement surfaces on one or other of said portions of said valve body.

Conveniently, said two or more location surfaces include inter-engaging alignment features for inter-engaging with each other such as to ensure correct alignment of the location surfaces.

Preferably, the arrangement includes a securing member to secure the first and second portions to each other.

A particularly preferred arrangement includes an outer casing comprising two portions having one or more first location features thereon and wherein said sub-frame further includes one or more second location feature for engagement with the said one or more first location features when said two portions are placed around said sub-frame.

Advantageously, said outer casing includes an inner surface and said first location features comprise axially extending protrusions on said sub-frame and said one or more second location feature comprise axially extending surfaces on said inner surface.

Preferably, said one or more first location features are on said front and back surfaces (of said sub-frame (opposite sides to the split line of P1).

Conveniently, said sub-frame may include a bottom surface extending generally perpendicular to plane P1 and for engagement with a correspondingly extending surface on a valve body.

In a particularly preferred approach, the sub-frame includes a valve body.

The arrangement may an electrical component which may be mounted on said sub-frame.

Advantageously, said outer casing may include a handle.

In a particularly preferred arrangement there is provided a cylinder valve assembly comprising a sub-frame as claimed in claim 1, a valve body around which said sub-frame is secured and an outer casing around said sub-frame and being secured to said sub-frame.

The above features and others of the present invention will now be described in more detail by way of example only with reference to the accompanying drawings, in which.

Figure 1:
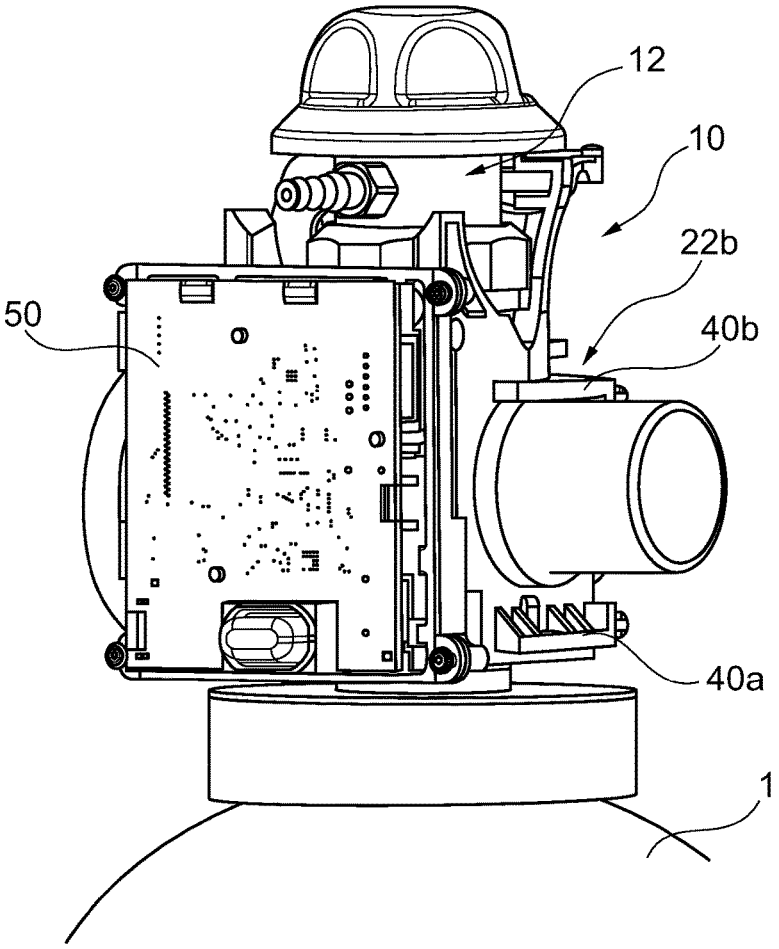
FIG. 1 is an isometric view of a sub-frame according to aspects of the present invention as applied to a valve body and illustrates the inter-relationship therebetween.
Figure 2:
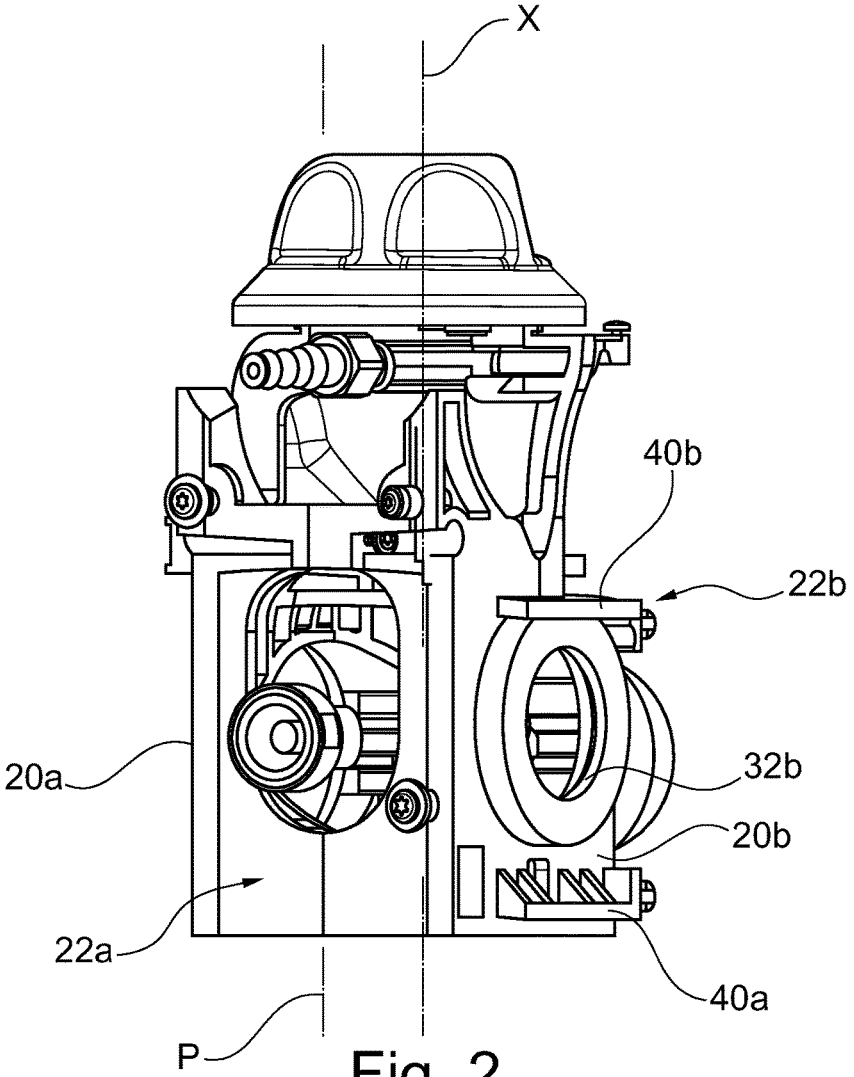
FIG. 2 is a view of the sub-frame of FIG. 1 with a portion of the valve body removed so as to illustrate internal features.
Figure 3:
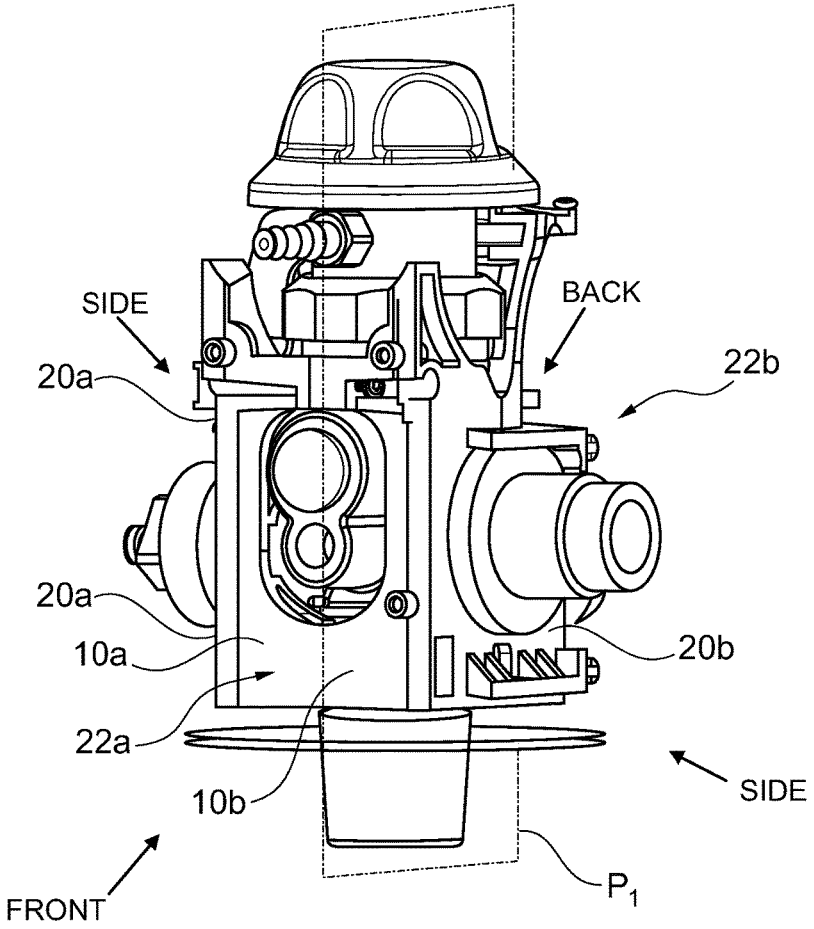
FIG. 3 is a view similar to FIG. 3 but shows some portions of the valve body in relation to the sub-frame.
Figure 4:
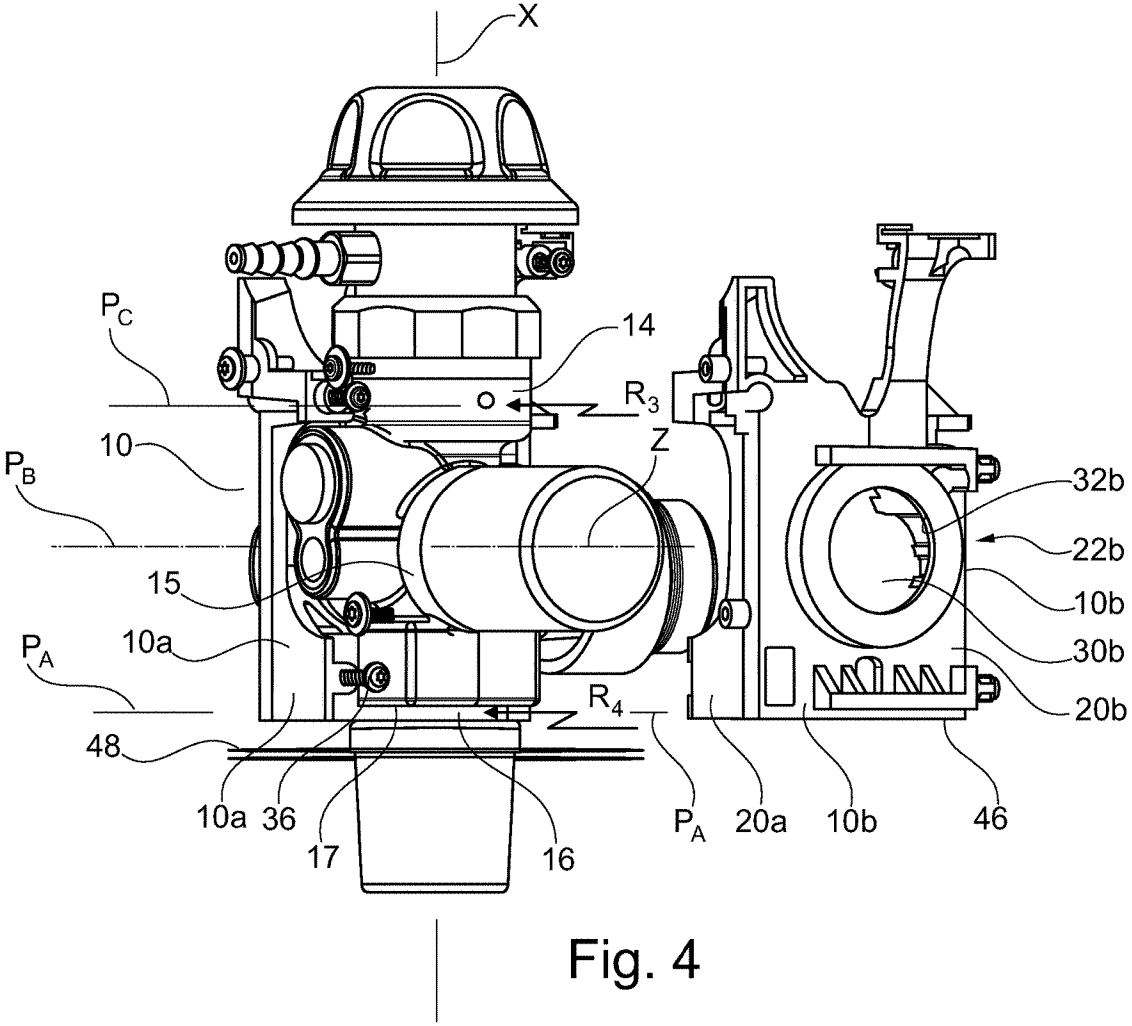
FIG. 4 is a first exploded view of the valve and sub-frame.
Figure 5:
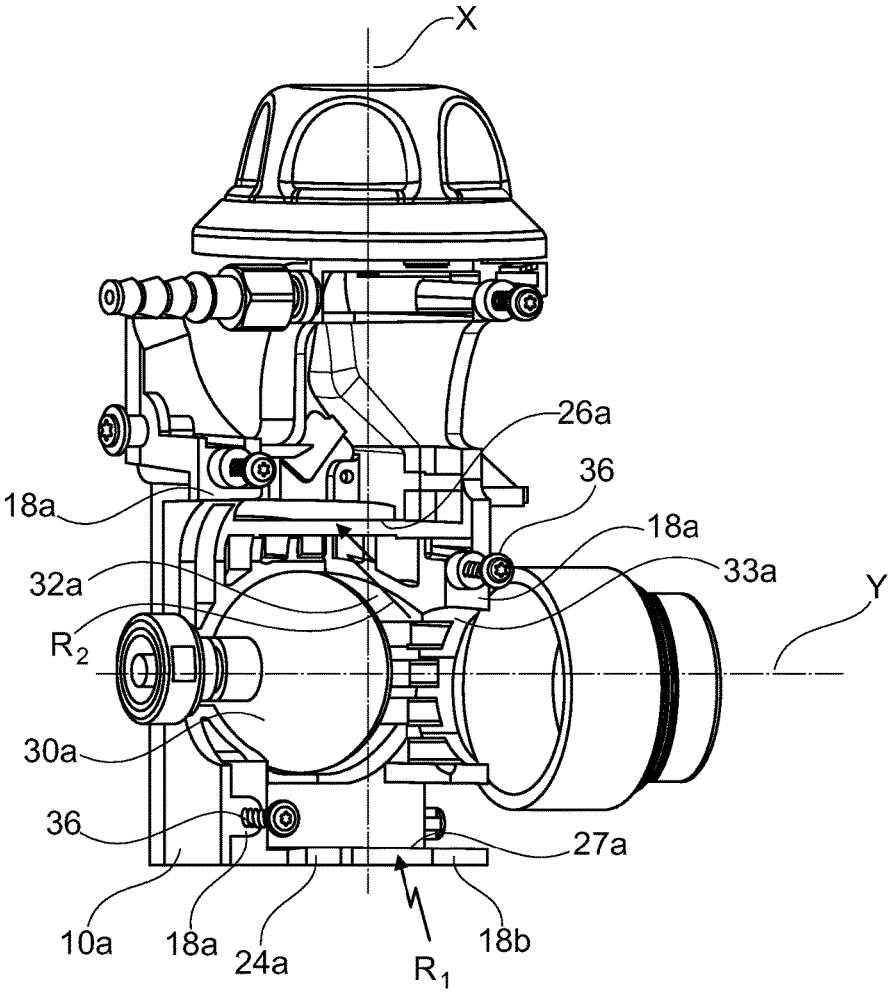
FIGS. 5 and 6 are views of different sides of the sub-frame of FIGS. 1 to 4.
Figure 6:
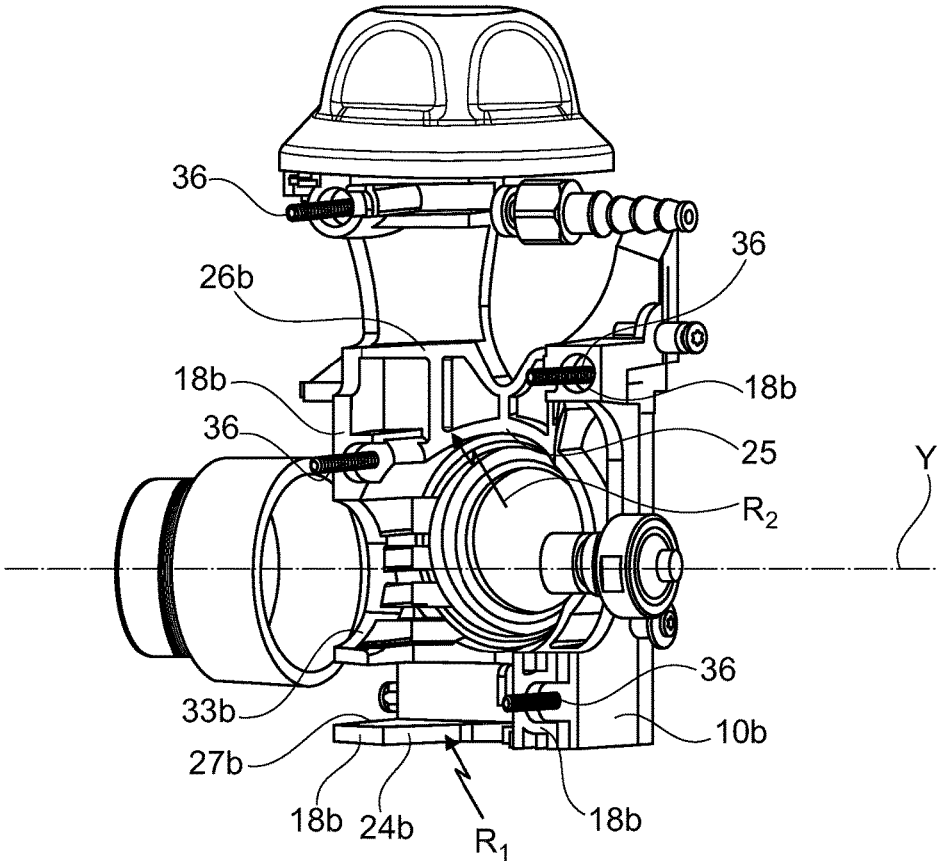
Figure 8:
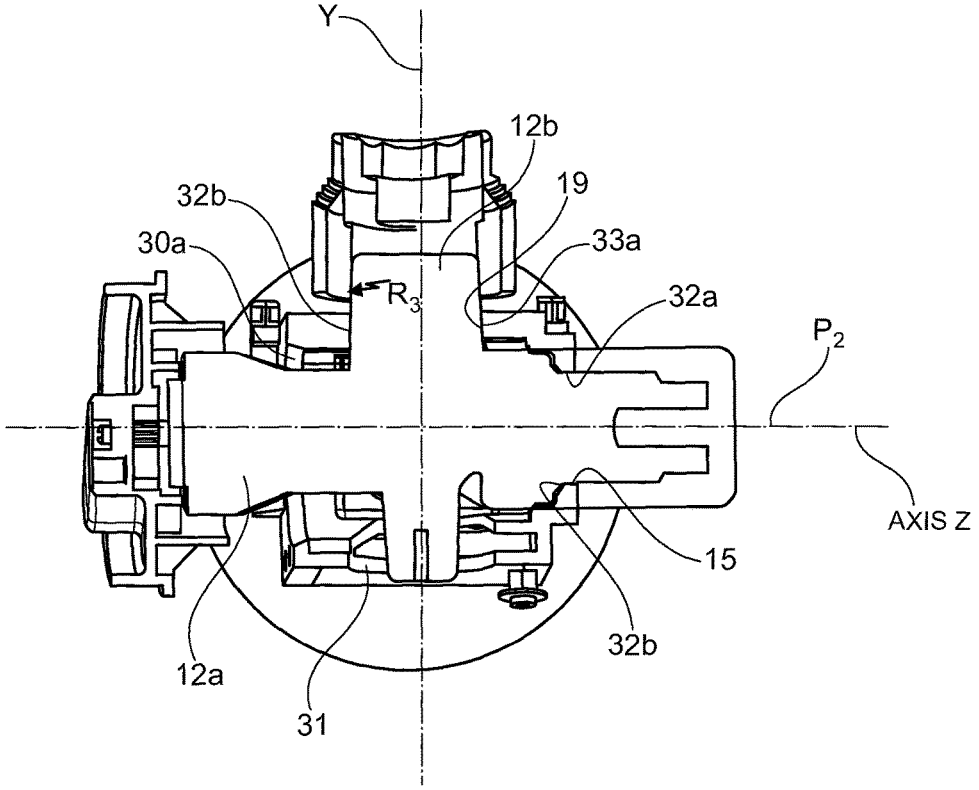

Referring now to the drawings in general but particularly to FIGS. 1 to 4, a sub-frame 10 for a valve body 12 having two or more location surfaces 14, 16, 17 (best seen in FIG. 4) and comprising first and second portions 10*a*, 10*b* having mutually confronting contact surfaces 18*a*, 18*b*, sides 20*a*, 20*b*, front and back surfaces 22*a*, 22*b* and mutually confronting engagement surfaces 24*a*, 24*b* and 26*a*, 26*b*. The mutually confronting contact surfaces 18*a*, 18*b* are shaped to engage with each other upon placement together of the two portions 10*a*, 10*b* whist the mutually confronting engagement surfaces 24*a*, 24*b* and 26*a*, 26*b* are shaped to engage with said one or more location surfaces 14, 16 on the valve body, as will be described in more detail later herein. Many valve bodies 12 are machined from solid material such as brass and include machined surfaces which the present invention may employ in order to provide a high degree of location and stability as well as substantially uniform surfaces for location purposes. These surfaces are best seen in FIG. 4 and generally comprise one or more surfaces 14, 16 extending circumferentially around a vertical axis X. A further reference surface may be provided as a surface 17 at the base of the valve and extend in a generally radial direction perpendicular to axis X, as seen in FIG. 4. In effect, this surface 17 is formed as an under-cut into the valve body when surface 16 is machined but it might just as easily be a non-machined but dimensionally stable and positionally accurate surface which may be used as a reference datum for attachment of a sub-frame 10. A still further location surface 15 may be provided as a circumferentially extending surface 15 extending around axis Z which is perpendicular to axis X. Axis Y of the valve body may be provided with a further pair of mutually confronting engagement surfaces 33*a*, 33*b* for engaging with surface 19 which extends around axis Y, as best seen in FIG. 8.

Whilst the function of these surfaces will be described in more detail later herein it will be appreciated that any two or more in combination are to be used as reference surfaces against which, in operation, corresponding surfaces of the sub-frame 10 are located such as to ensure accurate location of the sub-frame relative to the valve body 12 which may, otherwise, be relatively rough cast in external appearance with a high degree of dimensional tolerance.

It will be appreciated that the easiest way to produce the dimensionally accurate surfaces 14, 15, 16, 17 is to machine them and the easiest way of machining is to turn them on a lathe or the like such as to produce circular surfaces 14 to 16 and planar surfaces 17. As a consequence, the sub-frame 10 is provided with appropriately shaped surfaces 24*a*, 24*b*, 26*a*, 26*b*, and 32*a*, 32*b*, 33*a*, 33*b* which may include or comprise one or more curved surfaces 24*a*, 24*b*, 26*a*, 26*b*, 32*a*, 32*b*, 33*a*, 33*b* as well as one or more planar surfaces 27*a*, 27*b*. A combination of these surfaces is employed to provide suitable contact surfaces the dimensions and accuracy of which are taken into consideration when designing the sub-frame 10 such as to allow a close fit between it and the valve body 12 on at least two and preferably three of these surfaces. These surfaces in combination with confronting surfaces 18*a*, 18*b* combine to provide a close fitting sub-frame 10 around the valve body 12 the outer surfaces of which may then be used to mount other components discussed alter herein. It will be appreciated that the most appropriate shaped surface to match the circular surfaces of 14 and 16 are matching curved surfaces so each surface 24*a*, 24*b* and 26*a*, 26*b* preferably comprises a semi-circular recess in the appropriate mutually confronting contact surfaces 18*a*, 18*b* having a radius of curvature R1, R2 which is substantially equal to the radius of curvature R3, R4 of corresponding location surfaces 14, 16 on the valve body 12. When the sub-frame is assembled around the valve body 12 the planar surface 27*a*, 27*b* is also in close contact with planar surface 17 of the valve body 12 and, thus, the sub-frame is securely located relative to the valve by three points or surfaces of contact. When assembled, the mutually confronting contact surfaces 18*a*, 18*b* extend in a generally common plane P1, as shown best in FIG. 3. Preferably, plane P1 extends in a direction parallel to a longitudinal axis L of the valve 12 and plane P1 is coincident with a neutral plane P2 of the valve body when positioned therearound. Such contact and location provides for a stable and solid foundation upon which to build or append subsidiary equipment and features such as electrical components, handles, display apparatus etc.

Also shown in the drawings are one or more apertures 30*a*, 30*b* on said side faces 20*a*, 20*b* for receiving one or more portions 12*a*, 12*b* of the valve body 12 that may project outwardly from axis Z. Such projections may vary between valves so the apertures 30*a*, 30*b* may differ depending on the particular valve body 12 around which the sub-frame is positioned. In some arrangements it may also be appropriate to provide second surfaces (32*a*, 32*b*) for confronting or even possibly engaging surfaces 34*a*, 34*b* on the one or more portions 12*a*, 12*b* of the valve. Such detail is best seen in FIG. 8 of the attached drawings.

The two portions 12*a*, 12*b* are secured together by a securing means which, preferably, comprises one or more screws 36 but it will be appreciated that an adhesive or self-inter-engaging bayonet fittings may also be used.

Figure 7:
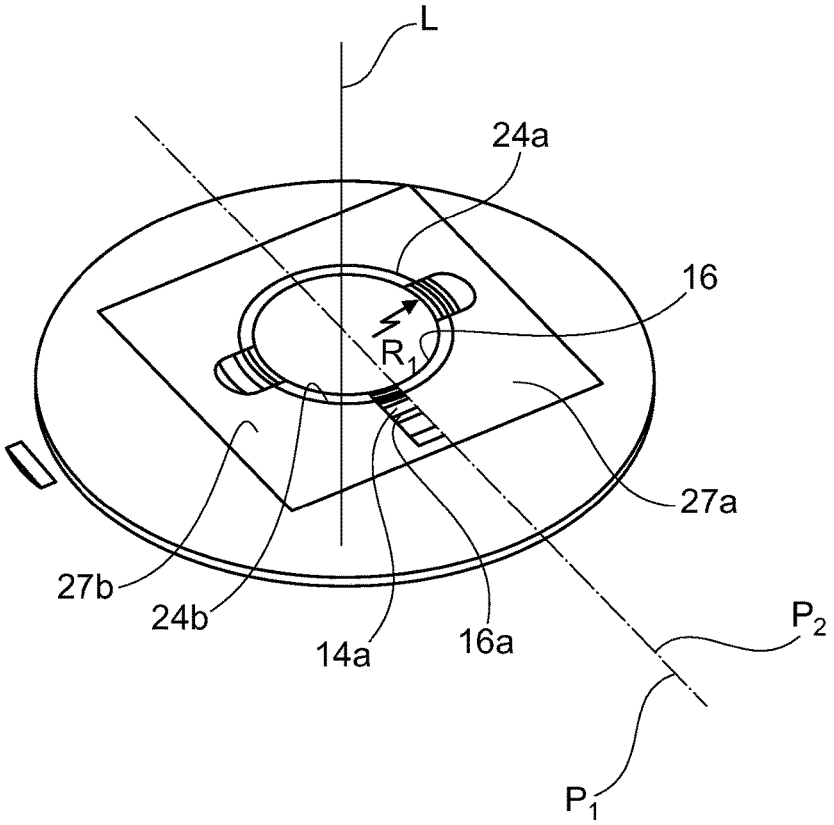
FIGS. 7 to 9 are cross-sectional views taken through the valve at positions AA, BB and CC of FIG. 1.
Figure 9:
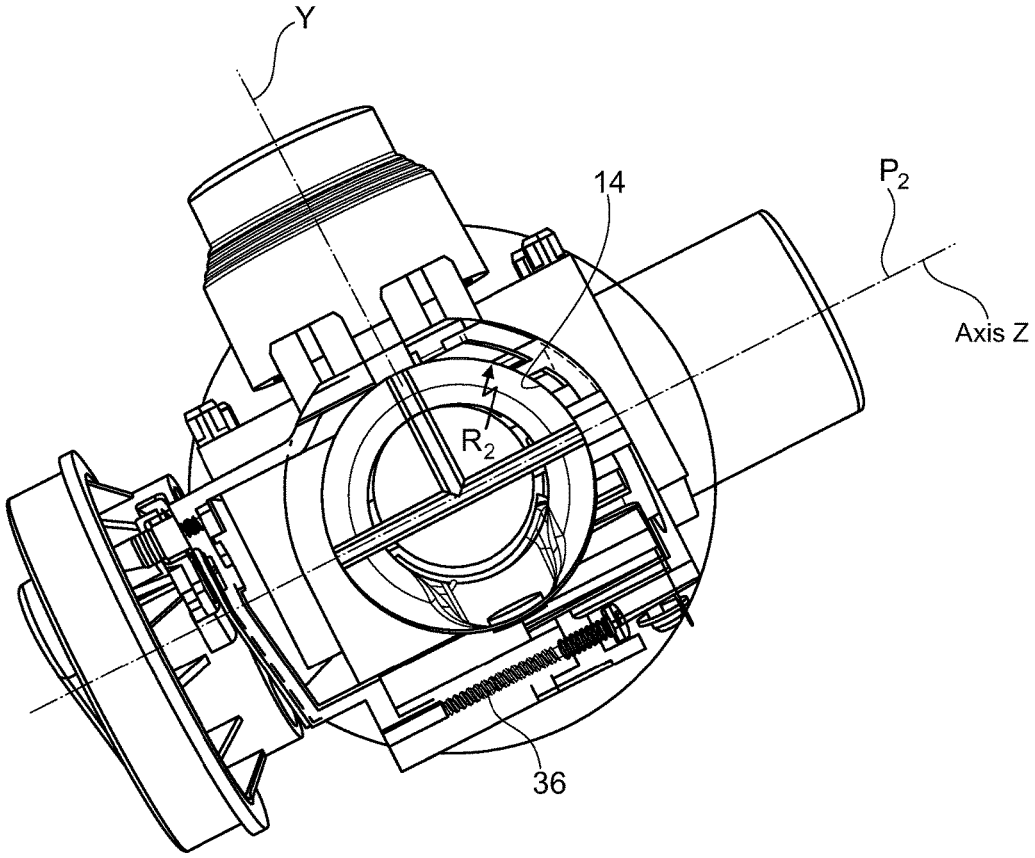

Reference is now made more particularly to FIGS. 7 to 9 which illustrate in detail the areas of contact between the valve 12 and the sub-frame. FIG. 7 is a cross-sectional view taken through the Plane $P_A$ of FIG. 4 which is the area associated with the lower location surface 16 and 17. From this figure it will be appreciated that surface 16 is closely surrounded by surfaces 24*a*, 24*b* which, between them, act to clamp around surface 16 such as to give a first location contact surface. The upper surface 27*a*, 27*b* of the sub-frame halves is also represented in this figure and is substantially co-planar with planar surface 17 of the valve body 12 such as to provide a second location contact surface. In operation, the contact between surfaces 17 and 27 will allow for the lifting of the valve and any cylinder attached thereto via the sub-frame, the advantage of which will become more apparent later herein. FIG. 8 is a cross-sectional view taken in the plane $P_B$ of FIG. 4 and illustrates in more detail how the two halves 12*a*, 12*b* of the sub-frame fit around and up against the valve body 12 whilst allowing appropriate clearance and/or contact. This figure illustrates the close contact between surfaces 32*a*, 32*b* and surface 15 in the Z axis but also illustrates the gap between aperture 30*a* and the valve body 12*a* at a dislocated portion of the Z axis. Still further, it illustrates the contact or engagement between sub-frame surfaces 33*a*, 33*b* and valve surface 19 in the Y axis as well as a corresponding clearance 31 between the sub-frame and the valve body 12 at an axially displaced position along axis Y. FIG. 9 is a cross-sectional view taken in the plane $P_C$ of FIG. 4 and illustrates the contact between surfaces 24*a*, 24*b* of the sub-frame 10 and surface 14 of the valve body.

It will be appreciated that to make a good fit between each of the valve and the sub-frame the radius of formation (R1, R2, R3) of the valve surfaces 16, 14 and 19 should closely match those of the corresponding surfaces with which they engage. In practice, the sub-frame may be made of plastics material so the dimensional accuracy of the engagement surfaces is of importance but remaining surfaces need not be moulded to as high a degree of accuracy. It will also be appreciated that the surfaces and contact therebetween will cause the sub-frame to be located securely in at least two and preferably 3 of axes X, Y and Z, which will greatly enhance the accuracy of location and the ability of the sub-frame 12 to carry load transmitted from the valve body 12.

Figure 10:
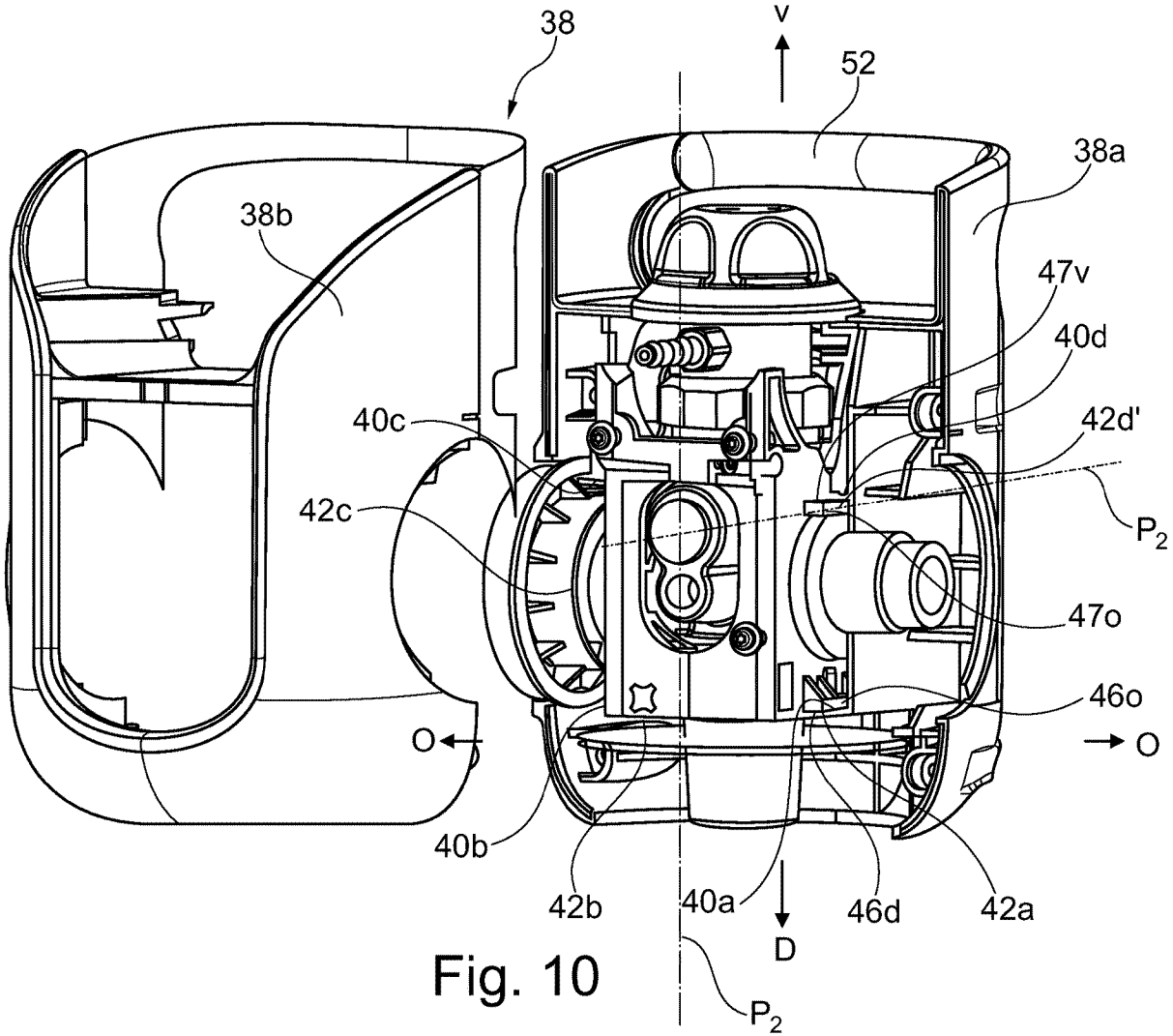
FIG. 10 is an exploded view of the assembled sub-frame positioned within one half of an outer casing which may incorporate a handle.
Figure 11:
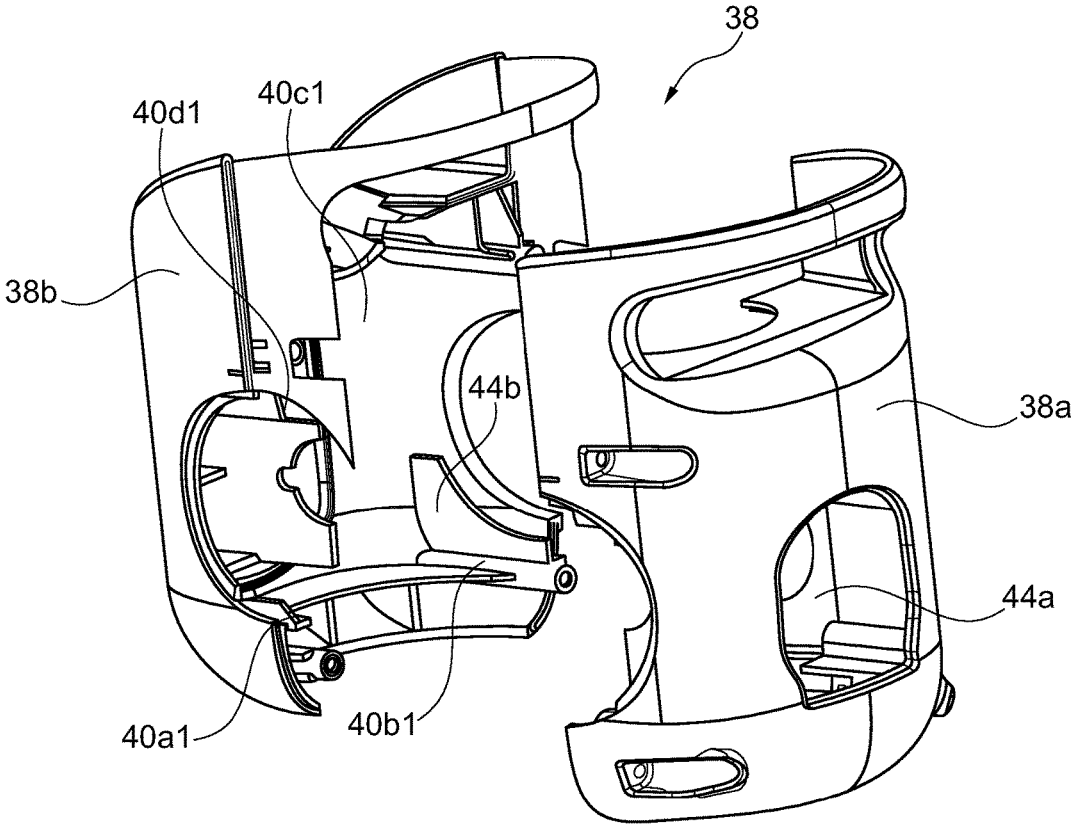
FIG. 11 is an exploded view of the outer casing of FIG. 10 and illustrates in more detail the location features which allow the casing to be assembled over the sub-frame.

The external surface of the sub-frame will now be discussed with particular reference to FIGS. 10 and 11. FIG. 10 illustrates the two portions 38*a*, 38*b* of an outer casing 38 which, in operation, surrounds the sub-frame 10 and, when assembled effectively becomes part of it. The casing portions are provided with one or more location features 40*a*, 40*b*, 40*c*, 40*d*, on portion 38*a* and corresponding items 40*a*1, 40*b*1, 40*c*1, 40*d*1 (hidden) on portion 38*b* which, in operation, cooperate with corresponding second location features 42*a*, 42*b*, 42*c*, 42*d* on portion 38*a* and corresponding items 42*a*1 42*b*1, 42*c*1, 42*d*1 (hidden) on portion 38*b* on the sub-frame when the two portions are placed around the sub-frame 10. Location features 40*a*, 40*b*, 40*a*1, 40*b*1 and 42*a*, 42*b*, 42*a*1, 42*b*1 form lower location features whilst location features 40*c*, 40*d*, 42*c*1, 42*d*1 and form upper location features. Features 40 each preferably comprise a longitudinal and axially extending protrusions on said sub-frame 10 which provide a sliding surface onto which the outer casing portions 38*a*, 38*b* can be located. In practice, the lower features 40*a*, 40*b* and 40*a*1, 40*b*1 include both lower surfaces 46*d* facing downwardly D, side surfaces 46*o* facing upwardly O whilst upper features include upper surfaces 47*u* facing upwardly U and outer surfaces 47*o* facing outwardly O. Between them these act to define a generally rectangular shaped guide onto which the outer casing portions 38*a*, 38*b* can slide onto when being positioned relative thereto. Features 42*a*, 42*b*, 42*c*, 42*d* and 42*a*1, 42*b*1, 42*c*1 and 42*d*1 each preferably comprise longitudinal and axially extending guide/location surfaces which are shaped to correspond to the outer shape of features 40 such that, in operation, they can engage with and slide over portions 40 as the two halves 38*a*, 38*b* are slid together around the sub-frame 10. Features 42 are best seen in FIG. 11 and from which it will be appreciated that they may comprise four mutually confronting corners of a frame system formed as an inner surface 44*a*, 44*b* of each of the two portions 38*a*, 38*b*. This framed structure effectively locates around the four location features 40 on the sub-frame 10 and the combination acts to securely locate the two halves 38*a*, 38*b* relative to the sub-frame 10, at which point the become one structural feature able to allow for the passage of carrying load between a handle 46 provided on the casing 38 and the valve body itself 12.

In the particular arrangement of the figures the first location features 40 are each provided on the front and back surfaces 22*a*, 22*b* of the sub-frame which, in effect, provides two such features on each half of the sub-frame and the split line of plane P1 lies between.

It will be appreciated that the sub-frame 10 may include the casing 38 and the valve body 12 as a fully assembled component. It will also be appreciated that the sub-frame 10 and/or the assembled component may also include an electrical component 50, as discussed above.

Still further, it will be appreciated that individual items described above may be used on their own or in combination with other items shown in the drawings or described in the description and that items mentioned in the same sentence as each other or the same drawing as each other need not be used in combination with each other. In addition the expression "means" may be replaced by actuator or system or device as may be desirable. In addition, any reference to "comprising" or "consisting" is not intended to be limiting any way whatsoever and the reader should interpret the description and claims accordingly. In particular, it will be appreciated that the assembly of the sub-assembly 10 around a valve body 12 and secured to it and the placement of a protective outer casing 32 around the sub-assembly 10 and secured to it provides a new form of cylinder valve assembly which will bring advantages to the market. The present invention is, therefore, considered to cover such an arrangement.

The invention claimed is:

1. A cylinder valve assembly having an outer casing and a sub-frame for a valve body having two or more location surfaces, said outer casing comprising a first portion and a second portion, said sub-frame comprising a first and a second portion having mutually confronting contact surfaces, sides and front and back surfaces and mutually confronting engagement surfaces wherein said mutually confronting contact surfaces are shaped to engage with each other upon placement together of the first and second portions of the sub-frame and said mutually confronting engagement surfaces are shaped to engage with one or other of said one or more location surfaces on the valve body when positioned therearound, the first portion of the outer casing having one or more lower first location features and one or more upper first location features thereon, and the second portion of the outer casing having one or more lower first location features and one or more upper first location features thereon, wherein said sub-frame further includes one or more lower second location features and one or more upper second location features for engagement with said one or more first location features of the first portion of the outer casing when said first and second portions of the outer casing are placed around said sub-frame; and the lower first location features of the first portion and the lower first location features of the second portion include lower surfaces facing downwardly and side surfaces facing upwardly; and the upper first location features of the first portion and the upper first location features of the second portion include upper surfaces facing upwardly and outer surfaces facing outwardly, and between the upper surfaces and the outer surfaces defines a generally rectangular shaped guide onto which the first and second portions of the outer casing slide onto when being positioned relative thereto.

2. The cylinder valve assembly as claimed in claim 1, and wherein said outer casing includes an inner surface and said first location features comprise axially extending protrusions on said sub-frame and said one or more second location features comprise axially extending surfaces on said inner surface.

3. The cylinder valve assembly as claimed in claim 1, wherein said sub-frame includes a bottom surface extending generally perpendicular to a common plane and for engagement with a correspondingly extending surface on a valve body.

4. The cylinder valve assembly as claimed in claim 1 and including an electrical component mounted on said sub-frame.

5. The cylinder valve assembly as claimed in claim 1, further comprising a securing member to secure the first and second portions to each other.

6. The cylinder valve assembly as claimed in claim 1, wherein said mutually confronting engagement surfaces include a curved surface for engagement with correspondingly curved surfaces on one or other of said one or more location surfaces on the valve body.

7. The cylinder valve assembly as claimed in claim 6, wherein said mutually confronting engagement surfaces comprise semi-circular recesses in the mutually confronting engagement surfaces having a radius of curvature and wherein said radius of curvature is equal to a radius of a corresponding location surfaces on the valve body.

8. The cylinder valve assembly as claimed in claim 1, wherein the mutually confronting contact surfaces each extend in a common plane when in contact with each other.

9. The cylinder valve assembly as claimed in claim 8, wherein said common plane extends in a direction parallel to a longitudinal axis of a valve around which said sub-frame is positioned and wherein said plane is coincident with a neutral plane of the valve body when positioned there-around.

10. The cylinder valve assembly as claimed in claim 1, wherein said sub-frame further includes one or more apertures on said side surfaces for receiving one or more portions of the valve body.

11. The cylinder valve assembly as claimed in claim 10, wherein said one or more apertures include second engagement surfaces for engaging with corresponding engagement surfaces on one or other of said portions of said valve body.

12. The cylinder valve assembly as claimed in claim 1, wherein the outer casing comprises two portions.

13. The cylinder valve assembly as claimed in claim 12, wherein said outer casing includes a handle.

* * * * *